US007712330B2

(12) United States Patent
Hosokawa et al.

(10) Patent No.: US 7,712,330 B2
(45) Date of Patent: May 11, 2010

(54) RECEIVER DRYER AND RECEIVER DRYER INTEGRATED CONDENSER

(75) Inventors: Kouji Hosokawa, Tokyo (JP); Takuji Furuta, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 700 days.

(21) Appl. No.: 11/474,612

(22) Filed: Jun. 26, 2006

(65) Prior Publication Data

US 2007/0017248 A1 Jan. 25, 2007

(30) Foreign Application Priority Data

Jul. 20, 2005 (JP) ..... 2005-209481
Sep. 13, 2005 (JP) ..... 2005-265607

(51) Int. Cl.
*F25B 39/04* (2006.01)

(52) U.S. Cl. ..... 62/509; 62/474

(58) Field of Classification Search ..... 62/474, 62/509; 34/294, 299
See application file for complete search history.

(56) References Cited

U.S. PATENT DOCUMENTS 5,038,582 A * 8/1991 Takamatsu ..... 62/474
5,394,710 A 3/1995 Matsuo et al.
6,158,503 A 12/2000 Gille et al.
6,301,926 B1 10/2001 Avequin et al.
2003/0121278 A1* 7/2003 Ichimura et al. ..... 62/474

FOREIGN PATENT DOCUMENTS

| | | |
|---|---|---|
| EP | 0795730 | 9/1997 |
| EP | 0915307 | 5/1999 |
| FR | 2839765 | 11/2003 |
| JP | 09217967 | 8/1997 |
| JP | 11-002475 | 1/1999 |
| JP | 11-211275 | 8/1999 |
| JP | 2001033121 | 2/2001 |
| WO | 02/070206 | 9/2002 |

* cited by examiner

*Primary Examiner*—Melvin Jones
(74) *Attorney, Agent, or Firm*—Fildes & Outland, P.C.

(57) ABSTRACT

A receiver dryer for storing and drying a refrigerant for an air conditioner is integrally fixed to a condenser to form an assembly. A condenser has refrigerant flow passages, and also has an opening portion for assembling a receiver dryer. In a body of the receiver dryer, a desiccant and members such as a filter are inserted. The refrigerant flows into the receiver dryer from the flow passage through a hole, and flows out to the outflow passage side through a strainer. A ring-shaped protruding portion is formed on the body by bulging, and the body is fixed to the condenser by a C ring.

7 Claims, 10 Drawing Sheets

RECEIVER DRYER AND RECEIVER DRYER INTEGRATED CONDENSER

The present application is based on and claims priority of Japanese patent applications Nos. 2005-209481 filed on Jul. 20, 2005 and 2005-265607 filed Sep. 13, 2005, the entire contents of which are hereby incorporated by reference.

BACKGROUND OF THE INVENTION

1. Field of the Invention

The present invention relates to a receiver dryer for storing and drying a refrigerant for an air conditioner and a receiver dryer integrated condenser.

2. Description of the Related Art

A receiver dryer which is provided in an air conditioner for a motor vehicle to store and dry a refrigerant is required to decrease the number of parts and achieve a smaller size and lighter weight.

Japanese Patent Publication No. 11-2475 discloses a receiver dryer of this type.

Japanese Patent Publication No. 11-211275 discloses a receiver dryer assembled integrally to a condenser.

The above-described conventional receiver dryers have a construction in which the opening of a tank is closed by a closing member, and the closing member and a connector are connected to each other by bolts.

SUMMARY OF THE INVENTION

An object of the present invention is to provide a receiver dryer in which a closing member and the like are omitted, the number and weight of parts are reduced, and the installation construction is simplified, and a receiver dryer integrated condenser.

To achieve the above object, a receiver dryer in accordance with the present invention has a function of storing a refrigerant used for an air conditioner and removing water in the refrigerant, includes a bottomed cylindrical body; a joint portion which includes a reduced-diameter portion having a passing hole of the refrigerant on the opening side of the body and is provided with a hole for allowing the refrigerant to pass through in a taper surface formed integrally by drawing; a desiccant charged in the body; a filter for preventing the desiccant from flowing out; and a strainer inserted in a tip end portion of the joint portion, and is constructed so as to have a joint construction in which the joint portion is fixed to a condenser by a mechanical fixing means.

The above-described taper-shaped portion need not necessarily be a taper if it can have a joint construction for fixing, which has a hole for allowing the refrigerant to pass through, the desiccant and the filter, and the strainer, and needless to say, can have a shape such that the diameter is decreased by a step shape.

The joint construction can include a ring-shaped protruding portion formed in the outer periphery portion of the body by bulging and a fixing member for fixing the protruding portion to the condenser. Also, the joint construction can be threads that are formed on the body and are engaged threadedly with the condenser.

Further, the joint construction can include a groove formed in the body and a fixing member for fixing the groove to the condenser.

By these joint constructions, the thickness of joint portion which has conventionally been needed for threadedly connecting the receiver dryer to the condenser can be decreased, so that a design can be made so that the joint portion has the same thickness as that of the body.

Also, to achieve the above object, a receiver dryer integrated condenser in accordance with the present invention is configured so that the receiver dryer includes a bottomed cylindrical body; a joint portion which includes a stepped reduced-diameter portion having a passing hole of the refrigerant on the opening side of the body and is provided with a hole for allowing the refrigerant to pass through in a taper surface formed integrally by drawing; a desiccant charged in the body; a filter for preventing the desiccant from flowing out; and a strainer inserted in a tip end portion of the joint portion, an opening portion of the condenser in which the joint portion of the receiver dryer is inserted communicates with a refrigerant inflow passage and a refrigerant outflow passage, and an outer shape of the joint portion of the receiver dryer and an inner shape of the opening portion of the condenser include a stepped hole for defining a space that accommodates an O-ring for sealing the receiver dryer and the condenser.

The receiver dryer in accordance with the present invention can configure an assembly by assembling the receiver dryer integrally to the refrigerant condenser and the like, which are other components of an air conditioner, by the joint portion. By this configuration, a smaller size and a lighter weight of air conditioner and a reduction in cost thereof can be achieved.

Also, the receiver dryer integrated condenser of the present invention can configure an assembly by assembling the sealing O-ring integrally to the refrigerant condenser, which is another component of an air conditioner, by the joint portion. By this configuration, a smaller size and a lighter weight of air conditioner and a reduction in cost thereof can be achieved.

DETAILED DESCRIPTION OF THE PREFERRED EMBODIMENTS

Figure 1:
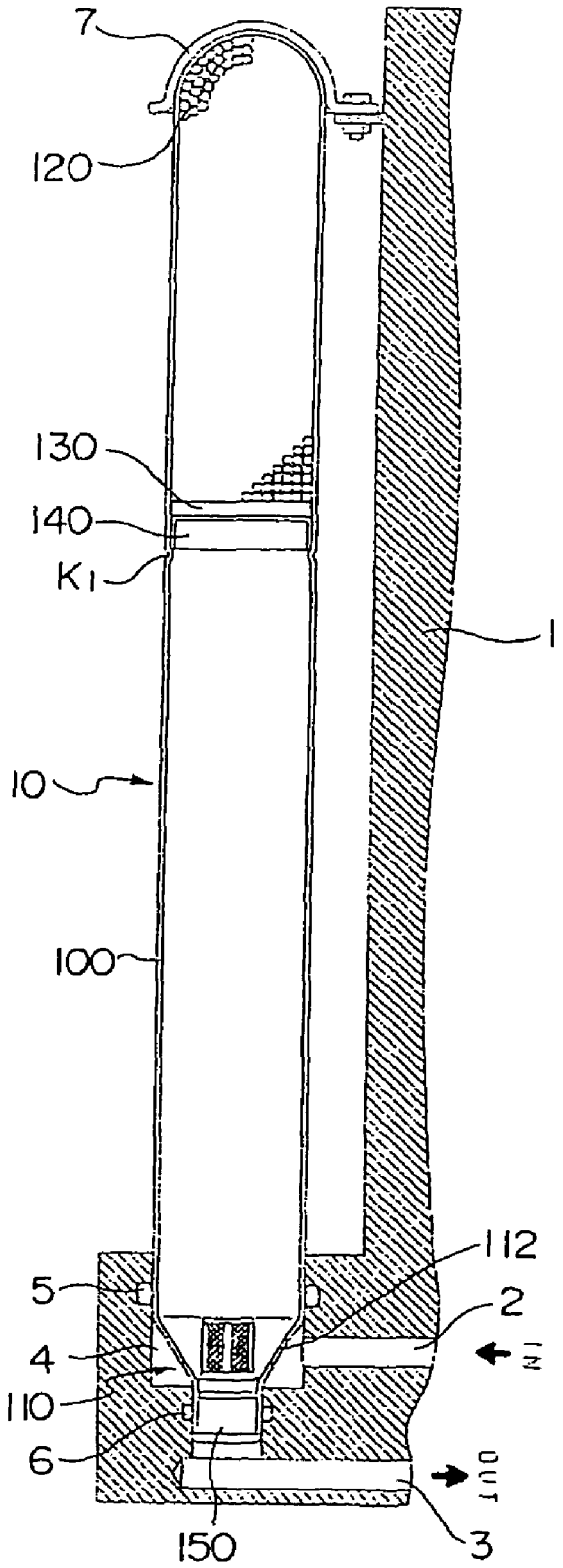
FIG. 1 is an explanatory view showing a general configuration of a receiver dryer in accordance with an embodiment of the present invention.

FIG. 1 shows a basic construction of an assembly in which a receiver dryer 10 is integrated with a condenser 1.

The condenser 1 has two refrigerant passages 2 and 3. In an opening portion 4 of the condenser 1, a joint portion of the receiver dryer is inserted, and the joint portion is sealed by seal members 5 and 6. The receiver dryer 10 is fixed to the condenser 1 by a mounting fixture 7.

The receiver dryer 10 has a body 100 made by forging a metallic material and a joint portion 110 formed on the open end side of the body 100. The body 100 is filled with a desiccant 120, and a filter 130 made of nonwoven fabric cloth is inserted in the body 100. On the opposite side of the filter 130, a reinforcing plate 140 made of punching metal or the like is inserted, and is fixed by a notch or a spinning portion $K_1$.

The joint portion 110 is formed into a tapered shape, and in the opening portion thereof at the tip end, a plastic-made strainer 150 is attached to prevent foreign matters in the flowing-out refrigerant from passing through. The taper surface is formed with a hole 112 through which the refrigerant flows in.

Figure 2:
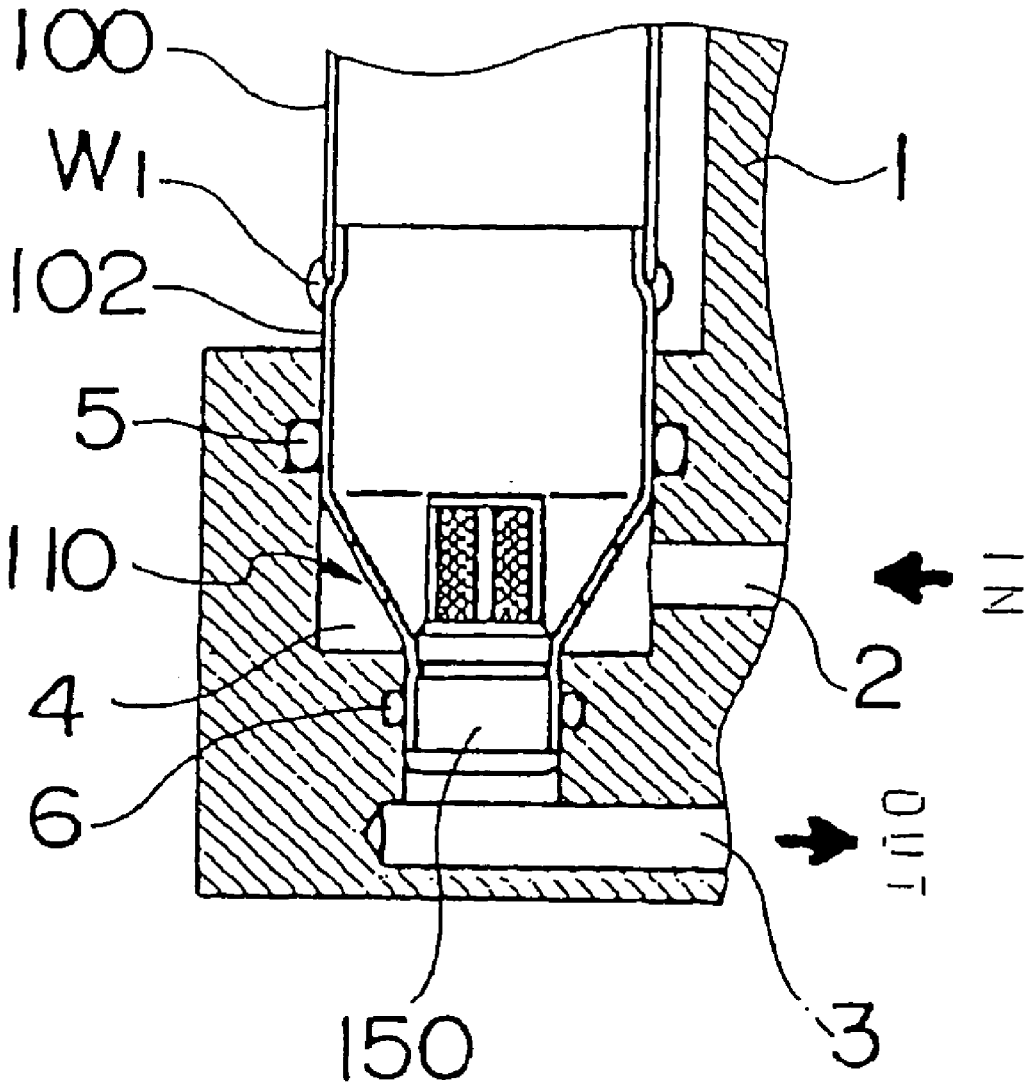
FIG. 2 is an explanatory view showing another example of a receiver dryer in accordance with an embodiment of the present invention.

FIG. 2 shows an example in which the joint portion 110 is constructed by a member 102 that is separate from the body 100. The joint member 102 is fabricated by pressing, and is joined to the body 100 by a welding portion $W_1$.

Figure 3:
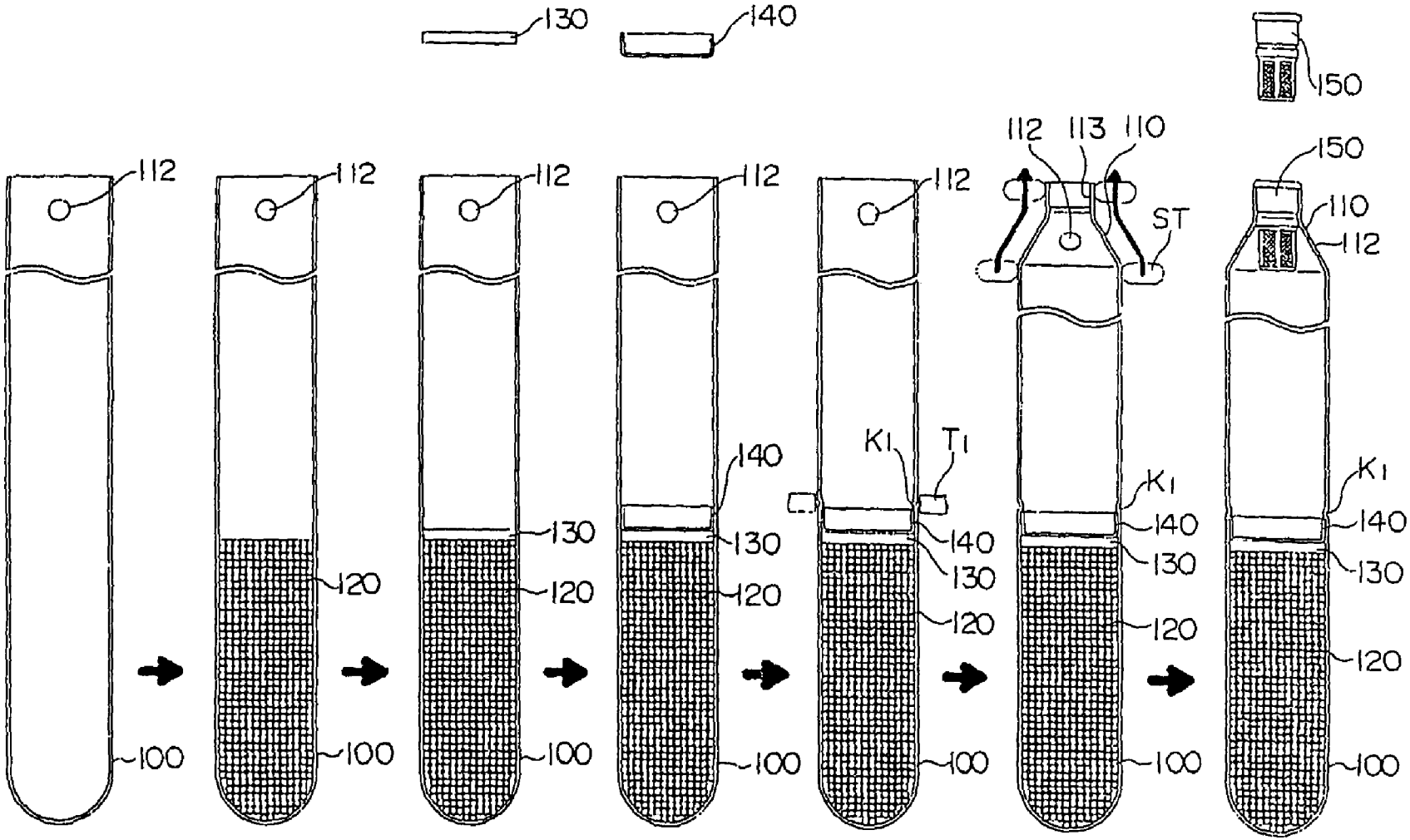
FIG. 3 is an explanatory view showing an assembly process of a receiver dryer in accordance with an embodiment of the present invention.

FIG. 3 is an explanatory view showing an assembly process of a receiver dryer in accordance with the present invention.

The body 100 having the hole 112 for refrigerant in the vicinity of the open end is prepared. After the desiccant 120 has been put in the body 100, the filter 130 and the reinforcing plate 140 are inserted, and a notch portion $K_1$ is formed by pressing a notch forming tool $T_1$ from the outside of the body 100. This notch portion may be a plurality of points at the outer periphery, or may be a continuous groove.

Next, the opening portion is drawn into a tapered shape with a spinning tool ST to form the joint portion 110. The strainer 150 is inserted in an opening portion 113 of the joint portion 110, by which the receiver dryer is completed.

Figure 4:
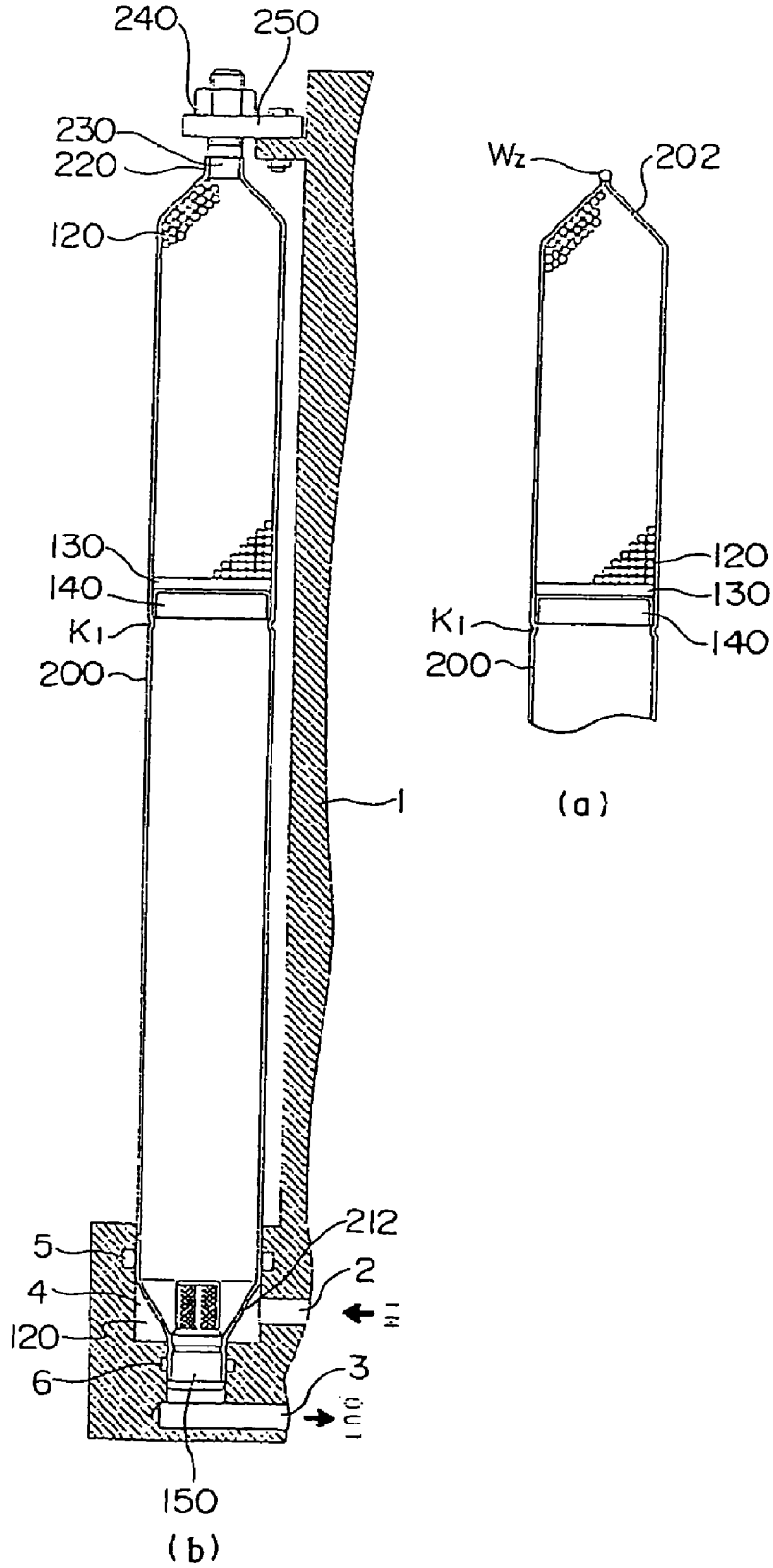
FIG. 4 is an explanatory view showing still another example of a receiver dryer in accordance with an embodiment of the present invention.

FIGS. 4(*a*) and 4(*b*) show an example in which the body is made by an aluminum pipe.

FIG. 4(*a*) shows a construction in which a tip end portion 202 of an aluminum-pipe body 200 is drawn by spinning, and is sealed by a welding portion $W_2$.

FIG. 4(*b*) shows a construction in which a tip end portion 220 of the aluminum-made body 200 is drawn by spinning, and a bolt 230 is welded. By the use of this bolt 230, the body 200 is fixed to a mounting fixture 250 fixed on the condenser 1 side with a nut 240.

The internal construction of the body 200 is the same as that of the body 100 in the above-described example.

Figure 5:
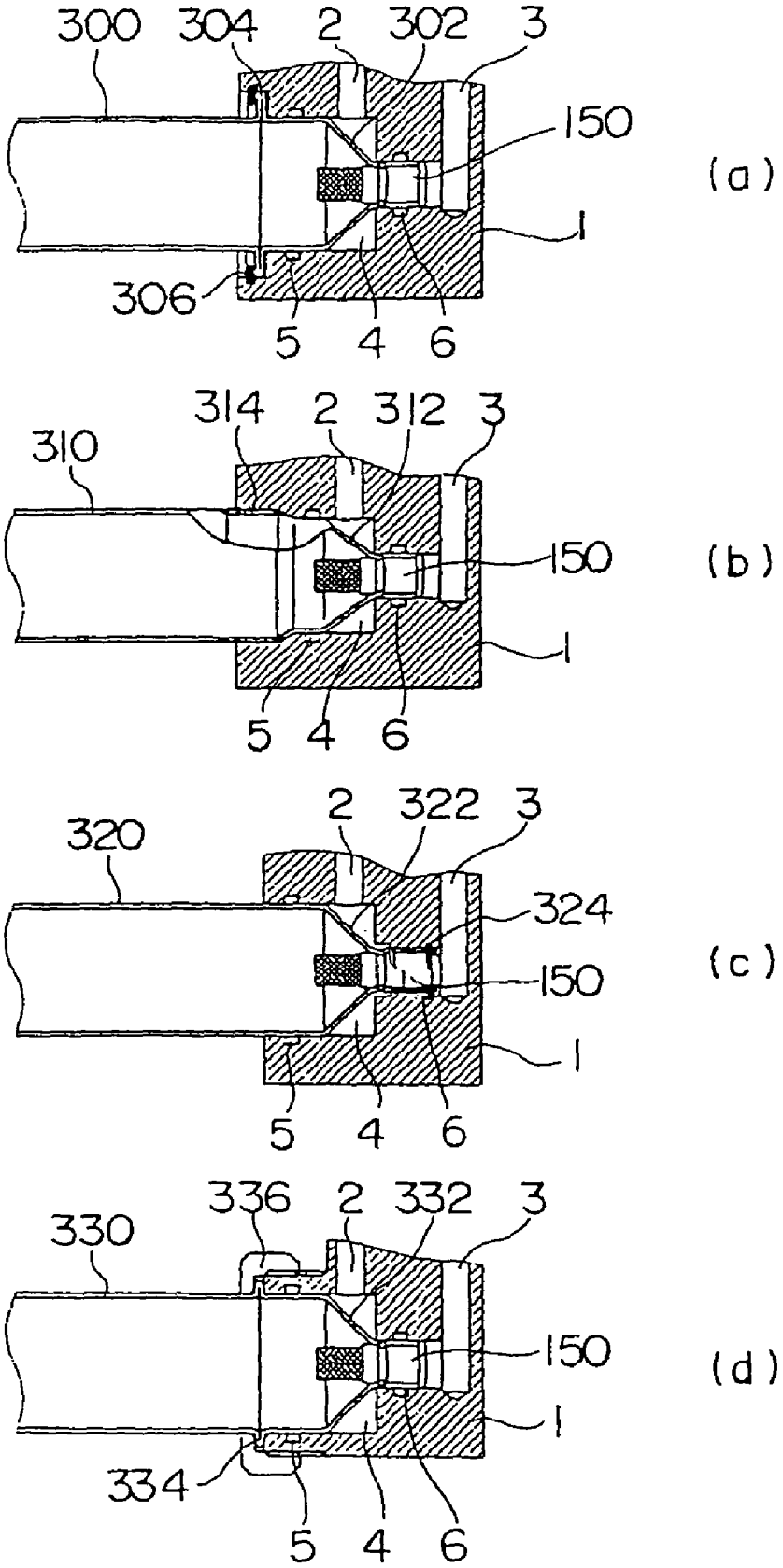
FIG. 5 is an explanatory view showing various examples of a joint construction of a receiver dryer in accordance with an embodiment of the present invention.
Figure 6:
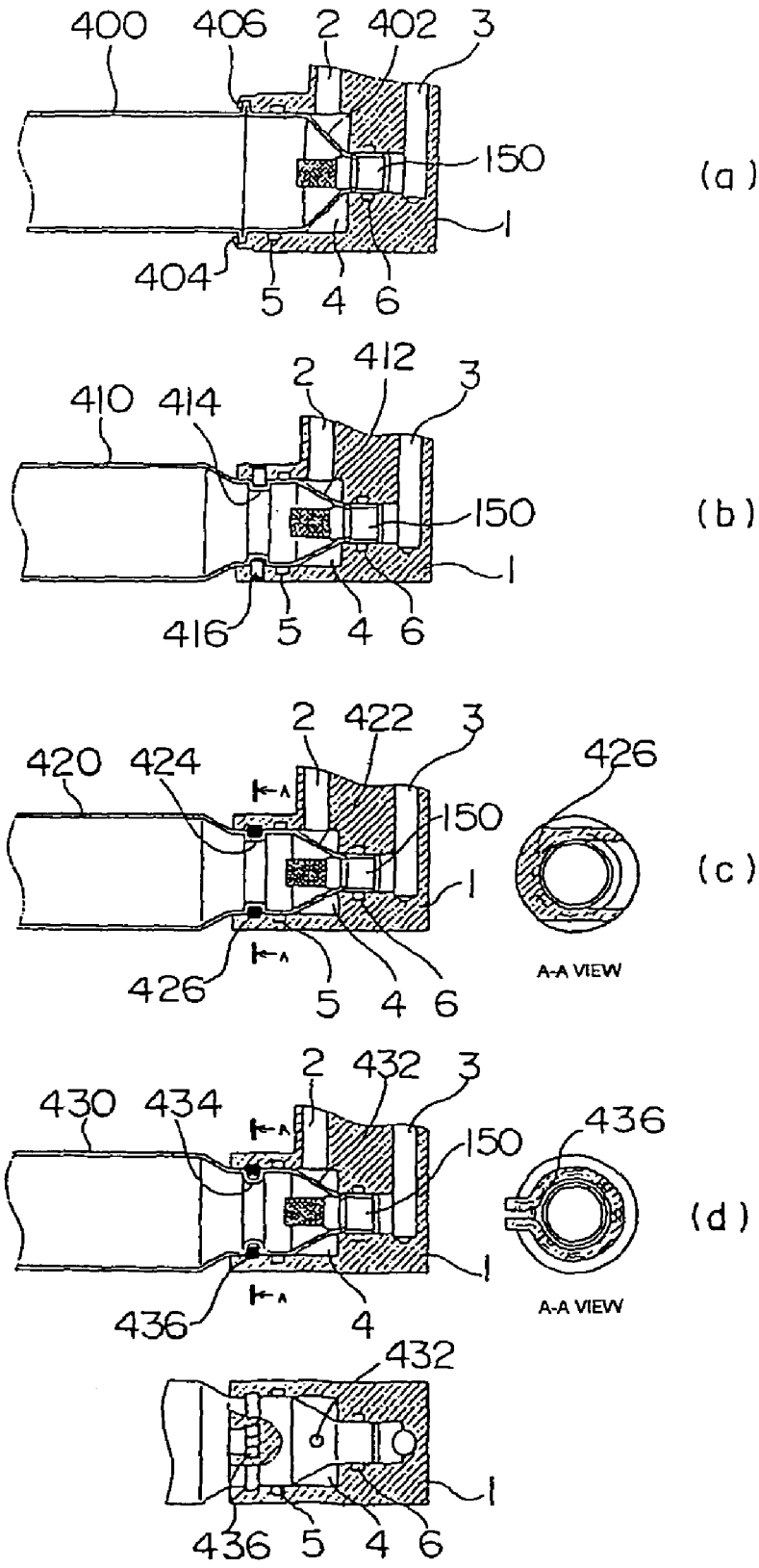
FIG. 6 is an explanatory view showing various examples of a joint construction of a receiver dryer in accordance with an embodiment of the present invention.

FIGS. 5 and 6 show various joint constructions for fixing the receiver dryer in accordance with the present invention to the condenser 1 side.

FIG. 5(*a*) shows a joint construction in which a ring-shaped protruding portion 304 is formed on a body 300 of the receiver dryer by bulging, and a C ring 306 is fitted in the inlet portion of the opening portion 4 for joint of the condenser 1, by which the receiver dryer is fixed.

The tip end of the body 300 is formed into a tapered shape, and a hole 302 through which the refrigerant sent from the inflow passage 2 passes is provided in the taper surface. The strainer 150 is inserted in the tip end portion of the body facing to the refrigerant outflow passage 3. Also, the two seal members 5 and 6 are disposed.

FIG. 5(*b*) shows a joint construction in which a round thread portion 314 is formed at the tip end of the large-diameter portion of a body 310, by which the receiver dryer is fixed to the condenser 1 by being screwed in the condenser 1. Other constructions are the same as those of the above-described example.

FIG. 5(*c*) shows a joint construction in which a thread portion 324 is formed at the tip end of the taper portion of a body 320, by which the receiver dryer is screwed in the condenser 1.

FIG. 5(*d*) shows a joint construction in which a ring-shaped protruding portion 334 is formed on a body 330 by bulging, by which the body 330 is fixed to the condenser 1 by a cap nut 336.

FIG. 6 shows other examples of joint constructions of the receiver dryer in accordance with the present invention.

FIG. 6(*a*) shows a joint construction in which a ring-shaped protruding portion 404 is formed on a body 400 by bulging, and a crimping portion 406 is provided at the inlet of the opening portion 4 of the condenser 1, by which the body 400 is fixed.

FIG. 6(*b*) shows a joint construction in which a groove 414 is formed in a body 410, and set screws 416 are turned in the condenser 1, by which the body 410 is fixed.

FIG. 6(*c*) shows a joint construction in which a groove 424 is formed in a body 420, and a spacer 426 is inserted in a groove in the condenser 1, by which the body 420 is fixed.

FIG. 6(*d*) shows a joint construction in which a groove 434 is formed in a body 430, and a retaining ring 436 is used, by which the body 430 is fixed.

Figure 7:
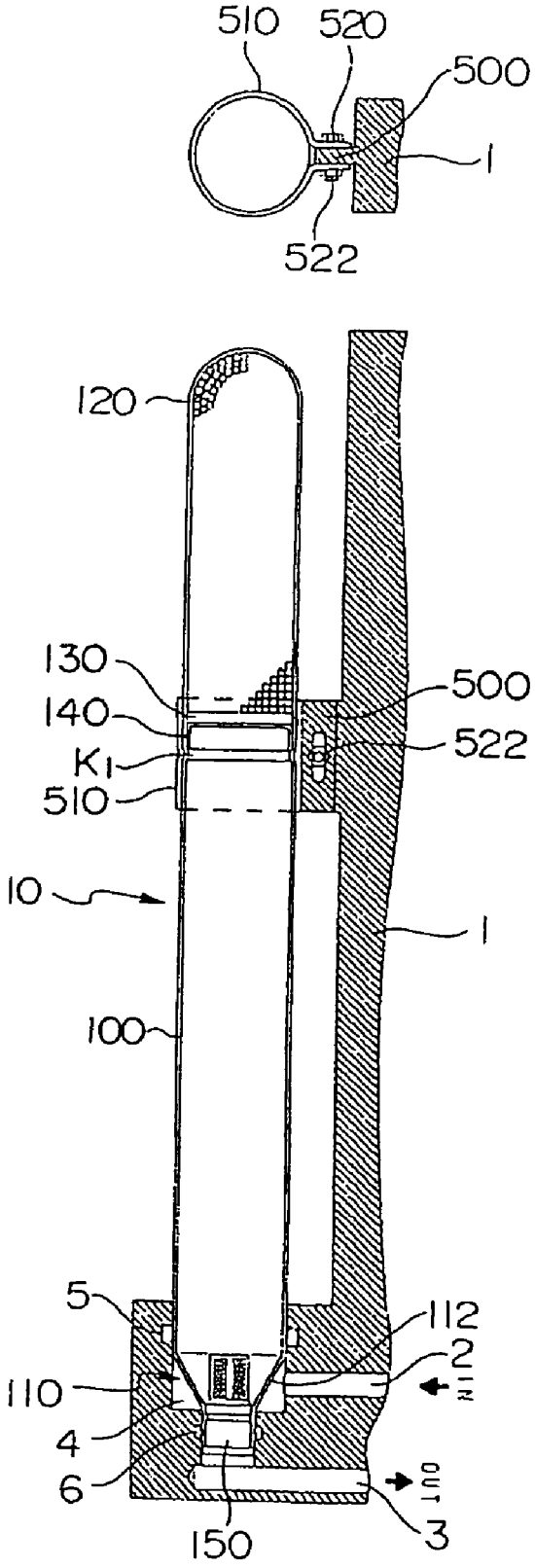
FIG. 7 is an explanatory view showing another example of a construction in which a receiver dryer in accordance with an embodiment of the present invention is installed to a condenser.

FIG. 7 shows an example of an assembling means for fixing the receiver dryer in accordance with the present invention to the condenser.

At a middle position of the body 100 of the receiver dryer 10, a spinning portion $K_1$ for fixing the reinforcing plate 140 is provided. A mounting portion 500 is provided on the condenser 1 side, and a ring band 510 for fixing is wound around the outer periphery of the body 100, by which the receiver dryer 10 is assembled to the condenser 1 by using a bolt 520 and a nut 522.

At this time, if a protruding portion corresponding to the spinning portion $K_1$ is provided on the inside of the ring band 510, the axial movement of the body 100 can also be prevented surely.

Figure 8:
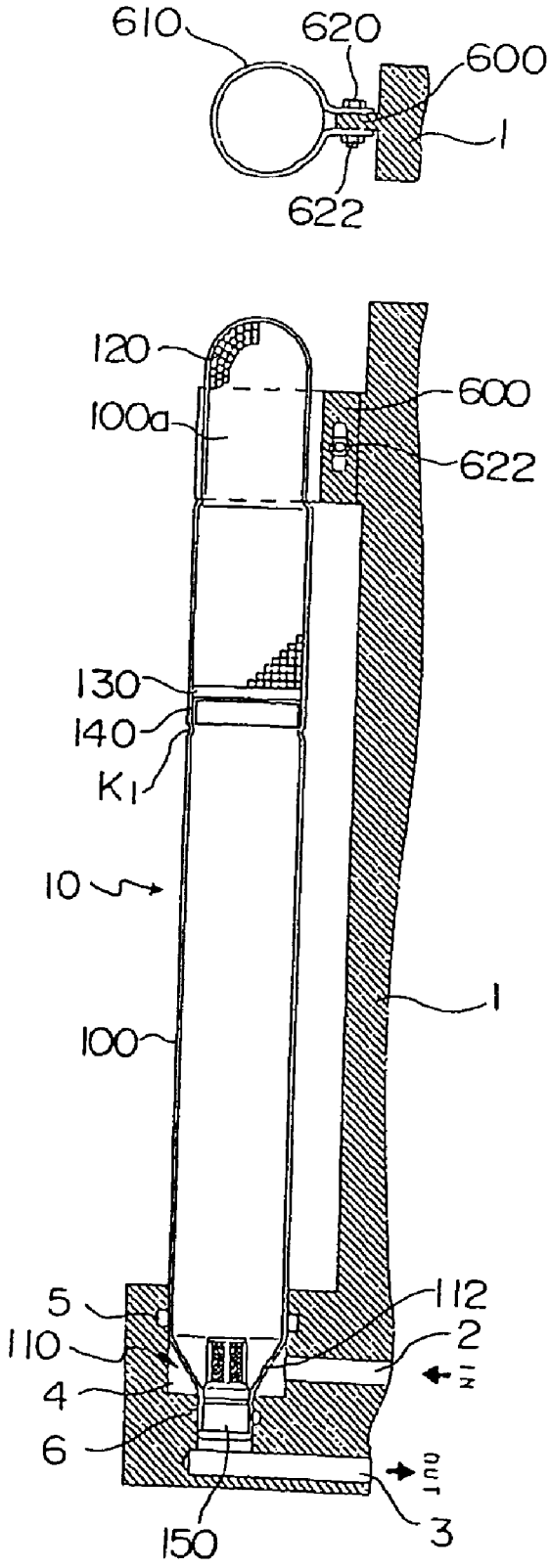
FIG. 8 is an explanatory view showing still another example of a construction in which a receiver dryer in accordance with an embodiment of the present invention is installed to a condenser.

FIG. 8 shows another example of an assembling means for fixing the receiver dryer in accordance with the present invention to the condenser.

The tip end portion on the opposite side to the joint portion 110 of the body 100 of the receiver dryer 10 is formed so as to have a small diameter to form a stepped portion 100*a*. A mounting portion 600 is provided on the condenser 1 side, and a ring band 610 is wound, by which the receiver dryer 10 is assembled to the condenser 1 by using a bolt 620 and a nut 622.

Since the receiver dryer 10 is fixed to the condenser 1 by utilizing the stepped portion 100*a*, the axial movement of the body 100 can also be prevented surely.

In the above-described examples, the example in which the joint portion of the receiver dryer is fixed to the condenser by a mechanical means and the example in which the body portion of the receiver dryer is fixed to the condenser by a mechanical means have been explained separately. However, it is a matter of course that the receiver dryer can be assembled to the condenser by using both of the fixing means.

Figure 9:
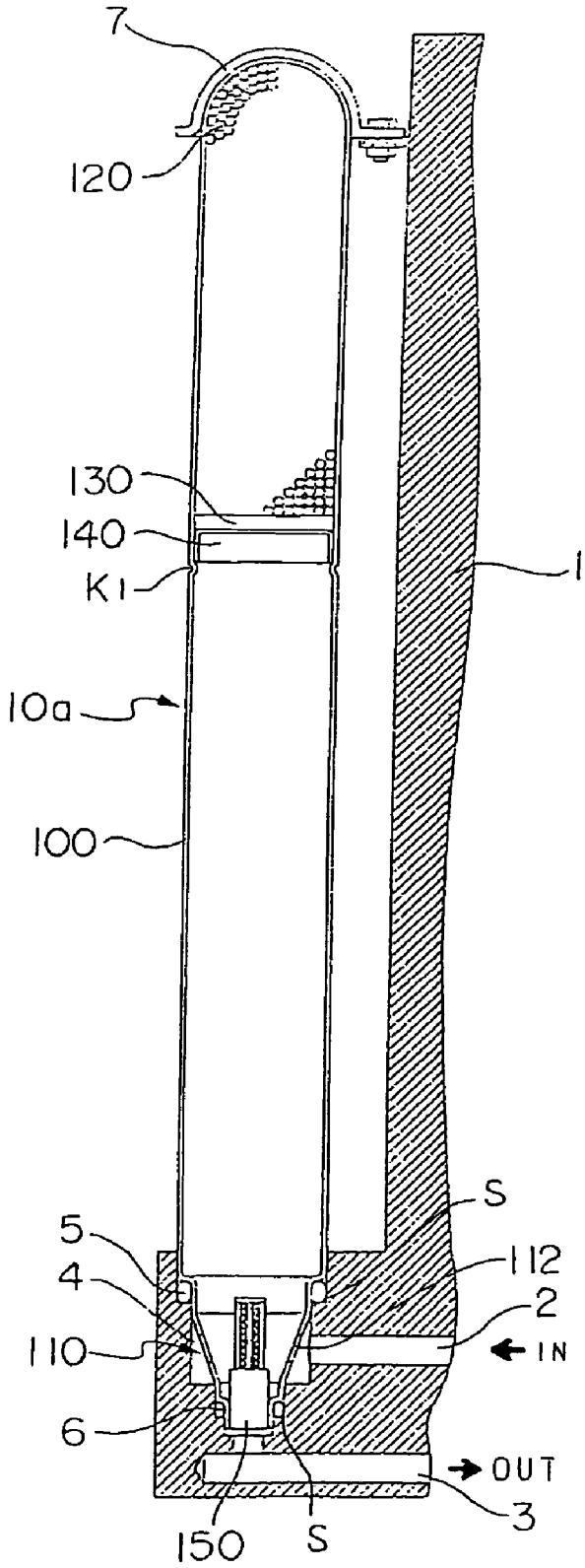
FIG. 9 is an explanatory view showing a configuration of a receiver dryer integrated condenser in accordance with an embodiment of the present invention.

FIG. 9 shows an example of an assembly in which a receiver dryer is integrated with the condenser 1.

The condenser 1 has the two refrigerant passages 2 and 3. In the opening portion 4 of the condenser 1, the joint portion of the receiver dryer is inserted, and the joint portion is sealed by the O-rings 5 and 6. A receiver dryer 10*a* is fixed to the condenser 1 by the mounting fixture 7.

The receiver dryer 10*a* has the body 100 made by forging a metallic material and the joint portion 110 formed on the open end side of the body 100. The body 100 is filled with the desiccant 120, and the filter 130 made of nonwoven fabric cloth is inserted in the body 100. On the opposite side of the filter 130, the reinforcing plate 140 made of punching metal or the like is inserted, and is fixed by the notch or the spinning portion $K_1$.

The joint portion 110 is formed into a tapered shape, and in the opening portion thereof at the tip end, the integrally molded plastic strainer 150 is attached to prevent foreign matters in the flowing-out refrigerant from passing through. The taper surface is formed with the hole 112 through which the refrigerant flows in.

Figure 10:
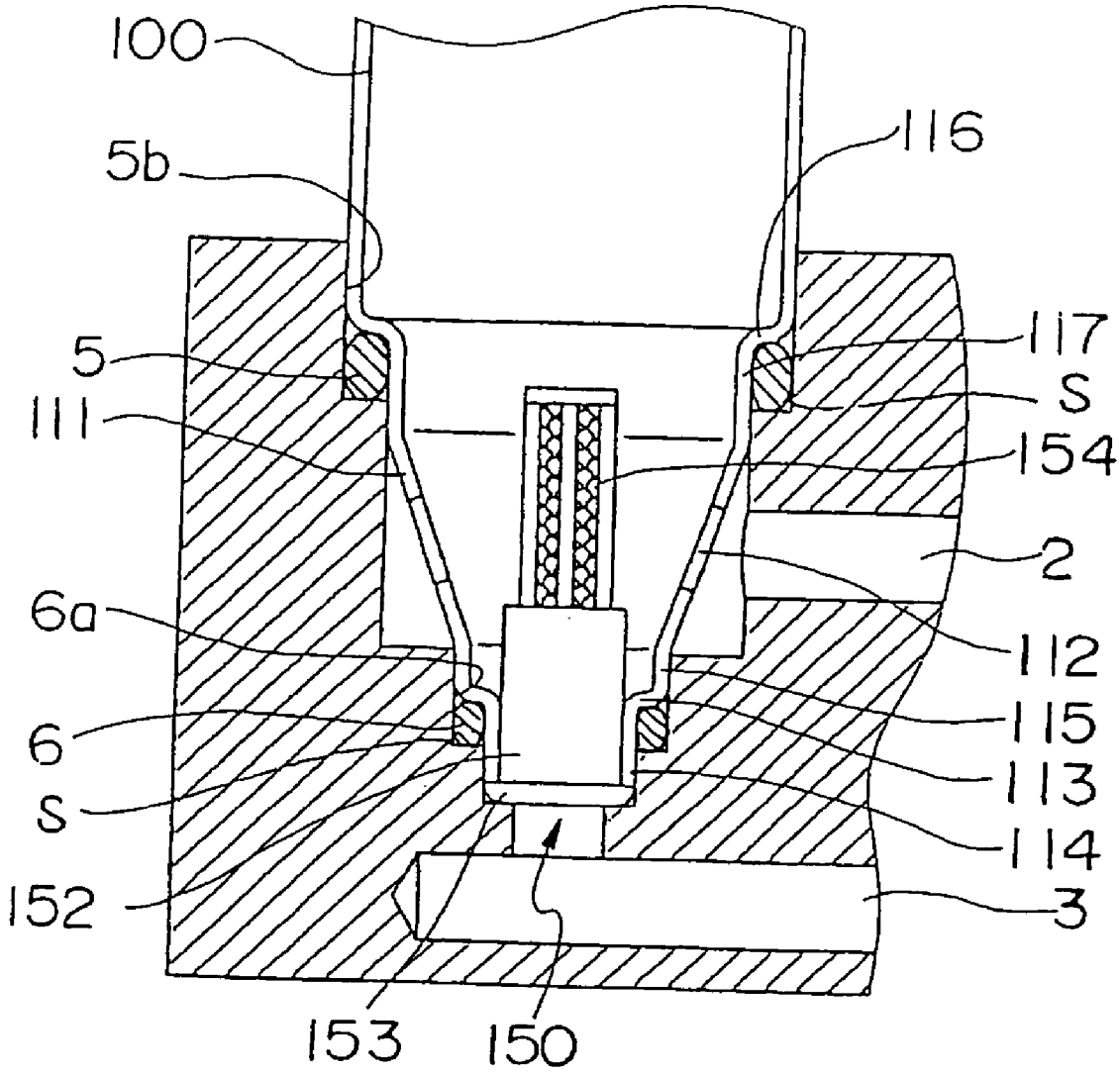
FIG. 10 is an enlarged view of a joint portion shown in FIG. 9.

FIG. 10 shows a construction for assembling the joint portion 110 at the tip end of the body 100 of the receiver dryer 10*a* in accordance with another embodiment of the present invention to the condenser 1. The joint portion 110 has a taper portion 111 formed by drawing, and the taper portion 111 is provided with the hole 112 for allowing the refrigerant to pass through. At the tip end of the taper portion 111, a neck portion 114 is formed.

Between the body 100 and the taper portion 111, a first step portion 116 and a first cylindrical portion 117 having a smaller diameter are formed. In the outer periphery portion of the cylindrical portion 117, the first O-ring 5, which is a seal member, is fitted. The condenser 1 is formed with a first stepped hole 5*b* that provides a space S for accommodating the first O-ring 5. By providing this stepped hole 5*b*, the annular groove for accommodating the O-ring can be omitted.

This first O-ring 5 prevents the refrigerant that flows in through the refrigerant passage 2 from passing through the outer periphery portion of the cylindrical portion 117 and leaking to the outside of the condenser 1.

The neck portion 114 at the tip end of the body 100 is inserted in the opening portion communicating with the refrigerant outflow passage 3.

Between the taper portion 111 and the neck portion 114 of the joint portion 110, a second cylindrical portion 115 having a larger diameter than the neck portion 114 is provided. Between the second cylindrical portion 115 and the neck portion 114 is provided a second step portion 113. The second O-ring 6 is installed in the outer periphery portion of the neck portion 114 by utilizing this step portion 113.

On the condenser 1 side, a second stepped hole 6*a* that provides a space S for accommodating the second O-ring 6 is formed. By providing this stepped hole 6*a*, the annular groove for accommodating the second O-ring 6 can be omitted.

As shown in FIG. 1, since the end portion on the opposite side of the body 100 is fixed by the mounting fixture 7, the first O-ring 5 supported by the step portion 116 and the second O-ring 6 supported by the step portion 113 can be held surely.

As the configuration of the mounting fixture for fixing the body 100 to the condenser 1 side, various types can be employed.

The strainer 150 is inserted in the neck portion 114 of the body 100.

The strainer 150 has a cylindrical portion 152 having a flange 153 and a mesh portion 154, and is manufactured integrally by molding a resin.

As described above, the receiver dryer in accordance with the present invention is configured so that the body, which is a cylindrical vessel for storing and drying a refrigerant, is fixed directly to the condenser or directly to the condenser with the joint portion being provided on the body. By this configuration, the receiver dryer can be assembled integrally to the condenser, so that not only simplified construction but also smaller size and lighter weight can be achieved.

What is claimed is:

1. A receiver dryer having a function of storing a refrigerant used for an air conditioner and removing moisture contained in the refrigerant, comprising:

a bottomed cylindrical body connected to a condenser;

a joint construction comprising a male connector portion integrally formed at a lower end of the body and a female receiver portion integrally formed at a part of the condenser;

the male connector portion having a reduced-diameter portion formed integrally by drawing and having a stepped shape insertable into the female receiver portion;

an inlet and an outlet provided at the reduced-diameter portion of the body so as to permit the refrigerant to pass through;

a desiccant disposed in the body;

a filter for preventing the desiccant from flowing out;

a strainer located in a tip end portion of the male connector portion, an O-ring as mechanical sealing means for sealing between the male connector portion and the female receiver portion; and a supporting means for supporting the body so as to maintain the male connector portion into the female receiver portion.

2. The receiver dryer according to claim 1, wherein the joint construction includes a ring-shaped protruding portion formed in an outer periphery portion of the body by bulging and a fixing member for fixing the protruding portion to the condenser.

3. The receiver dryer according to claim 1, wherein the joint construction includes a groove formed in the body and a fixing member for fixing the groove to the condenser.

4. The receiver dryer according to claim 1, wherein a tubular member is used, an end portion of the body on the opposite side to the joint construction is drawn by spinning and is sealed by welding to form a bottom portion.

5. A receiver dryer having a function of storing a refrigerant used for an air conditioner and removing moisture contained in the refrigerant, comprising:

a bottomed cylindrical body; a joint construction which includes a reduced-diameter portion having a passing hole for the refrigerant on an opening side of the body and is provided with a hole for allowing the refrigerant to pass through in a surface formed integrally by drawing; a desiccant charged in the body; a filter for preventing the desiccant from flowing out; and a strainer inserted in a tip end portion of the joint construction, wherein the body is held by a bracket fixed to a condenser to integrally assemble the receiver dryer to the condenser.

6. A receiver dryer integrated condenser in which the receiver dryer has a function of storing a refrigerant used for an air conditioner and removing moisture contained in the refrigerant, and comprises:

a bottomed cylindrical body; a joint construction which includes a stepped reduced-diameter portion having a passing hole for the refrigerant on an opening side of the body and is provided with a hole for allowing the refrigerant to pass through in a taper surface formed integrally by drawing; a desiccant charged in the body; a filter for preventing the desiccant from flowing out; and a strainer inserted in a tip end portion of the joint construction, an opening portion of the condenser in which the joint construction of the receiver dryer is inserted communicates with a refrigerant inflow passage and a refrigerant outflow passage, and an outer shape of the joint construction of the receiver dryer and an inner shape of the opening portion of the condenser include a stepped hole for defining a space that accommodates an O-ring for sealing the receiver dryer and the condenser.

7. The receiver dryer integrated condenser according to claim 6, wherein the strainer has a cylindrical portion and a mesh portion, which are inserted in an opening portion of the receiver dryer, and is manufactured integrally by molding a resin.

* * * * *